US006811424B2

(12) United States Patent
Seminara et al.

(10) Patent No.: US 6,811,424 B2
(45) Date of Patent: Nov. 2, 2004

(54) ELECTRICAL CONNECTOR HAVING CONNECTOR POSITION ASSURANCE MEMBER

(75) Inventors: Phillip G. Seminara, Niles, OH (US); William R. Lyons, Southfield, MI (US); Cecil Brown, Detroit, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/401,319

(22) Filed: Mar. 26, 2003

(65) Prior Publication Data

US 2004/0192099 A1 Sep. 30, 2004

(51) Int. Cl.[7] ..... H01R 13/627
(52) U.S. Cl. ..... 439/352; 439/188
(58) Field of Search ..... 439/352, 188, 439/353, 555, 557, 675, 944, 488–489, 701, 752, 595, 466

(56) References Cited

U.S. PATENT DOCUMENTS

| | | | | | |
|---|---|---|---|---|---|
| 4,714,433 | A | | 12/1987 | Rider, Jr. | 439/310 |
| 4,906,203 | A | * | 3/1990 | Margrave et al. | 439/188 |
| 4,906,204 | A | * | 3/1990 | Metzger | 439/352 |
| 5,236,373 | A | | 8/1993 | Kennedy | 439/347 |
| 5,241,910 | A | | 9/1993 | Cunningham et al. | 102/530 |
| 5,257,944 | A | | 11/1993 | Kennedy | 439/347 |
| 5,275,575 | A | | 1/1994 | Cahaly et al. | 439/188 |
| 5,288,242 | A | | 2/1994 | Muzslay | 439/349 |
| 5,314,345 | A | | 5/1994 | Cahaly et al. | 439/188 |
| 5,529,507 | A | * | 6/1996 | Felix et al. | 439/188 |
| 5,605,471 | A | | 2/1997 | Plyler | 439/489 |
| 5,616,045 | A | | 4/1997 | Gauker | 439/352 |
| 5,681,178 | A | | 10/1997 | Kunkle et al. | 439/352 |
| 5,685,743 | A | | 11/1997 | Schmidt et al. | 439/701 |
| 5,688,141 | A | | 11/1997 | Dullin | 439/352 |
| 5,746,618 | A | * | 5/1998 | Gauker | 439/352 |
| 5,775,930 | A | | 7/1998 | Model et al. | 439/352 |

(List continued on next page.)

FOREIGN PATENT DOCUMENTS

| | | | |
|---|---|---|---|
| DE | 4317344 | A1 | 12/1994 |
| DE | 19617792 | A1 | 11/1997 |
| DE | 10032234 | A1 | 1/2002 |
| DE | 10151956 | A1 | 7/2002 |
| EP | 0112429 | A1 | 12/1982 |
| EP | 0591948 | B1 | 1/1997 |
| EP | 0591947 | B1 | 3/1997 |
| EP | 1124291 | A2 | 8/2001 |
| EP | 1130692 | A2 | 9/2001 |
| EP | 1207591 | A2 | 5/2002 |

*Primary Examiner*—P. Austin Bradley
*Assistant Examiner*—Edwin A. Leon
(74) *Attorney, Agent, or Firm*—Harrington & Smith, LLP

(57) ABSTRACT

An electrical connector including a housing, electrical contacts and a connector position assurance (CPA) member. The housing has deflectable cantilevered mating connector latch arms. The latch arms are movable between a latched position and an unlatched position. The CPA member is movably mounted to the housing between an open position and a closed position. The CPA member includes a first section and a deflectable second section. The second section includes a cam surface for contacting a housing of the mating electrical connector and being deflected as the CPA member is moved from the open position to the closed position and an interference portion adapted to contact the latch arms when the latch arms are not in their latched position such that the CPA member is blocked from reaching the closed position unless the latch arms are in their latched positions.

23 Claims, 12 Drawing Sheets

U.S. PATENT DOCUMENTS

| | | | | | |
|---|---|---|---|---|---|
| 5,827,083 | A | | 10/1998 | Dullin | 439/188 |
| 5,863,214 | A | | 1/1999 | Hanak | 439/352 |
| 5,895,282 | A | | 4/1999 | Little | 439/332 |
| 5,924,885 | A | | 7/1999 | Pacher | 439/352 |
| 5,993,230 | A | | 11/1999 | Gauker et al. | 439/188 |
| 6,004,153 | A | | 12/1999 | Myer et al. | 439/352 |
| 6,045,388 | A | * | 4/2000 | Higgins et al. | 439/352 |
| 6,045,404 | A | | 4/2000 | Myer | 439/595 |
| 6,109,955 | A | | 8/2000 | Hanazaki et al. | 439/489 |
| 6,126,482 | A | | 10/2000 | Stabile | 439/582 |
| 6,149,448 | A | | 11/2000 | Haller et al. | 439/188 |
| 6,203,342 | B1 | * | 3/2001 | Gauker et al. | 439/188 |
| 6,234,826 | B1 | | 5/2001 | Wilber et al. | 439/352 |
| 6,250,952 | B1 | | 6/2001 | Shiga et al. | 439/466 |
| 6,261,115 | B1 | | 7/2001 | Pederson et al. | 439/352 |
| 6,276,953 | B1 | | 8/2001 | Gauker et al. | 439/352 |
| 6,290,539 | B1 | | 9/2001 | Wilber et al. | 439/595 |
| 6,328,589 | B1 | | 12/2001 | Annecke | 439/352 |
| 6,354,860 | B1 | * | 3/2002 | Miller et al. | 439/352 |
| 6,361,348 | B1 | | 3/2002 | Hall et al. | 439/352 |
| 6,364,683 | B1 | | 4/2002 | Kohno | 439/352 |
| 6,383,036 | B1 | | 5/2002 | Steinhauser et al. | 439/752 |
| 6,406,319 | B2 | | 6/2002 | Pederson et al. | 439/352 |
| 6,435,895 | B1 | | 8/2002 | Fink et al. | 439/352 |
| 6,488,520 | B1 | * | 12/2002 | Hayes et al. | 439/188 |
| 6,514,098 | B2 | | 2/2003 | Marpoe, Jr. et al. | 439/352 |
| 6,530,785 | B1 | | 3/2003 | Hwang | 439/76.1 |
| 2002/0111059 | A1 | | 8/2002 | Raudenbush et al. | 439/352 |
| 2002/0115332 | A1 | | 8/2002 | Myer et al. | 439/352 |
| 2003/0049962 | A1 | | 3/2003 | Raudenbush et al. | 439/489 |

* cited by examiner

ELECTRICAL CONNECTOR HAVING CONNECTOR POSITION ASSURANCE MEMBER

BACKGROUND OF THE INVENTION

1. Field of the Invention

The present invention relates to electrical connectors and, more particularly, to an electrical connector having a connector position assurance (CPA) member.

2. Brief Description of Prior Developments

Electrical connectors for use with vehicle air bag gas generators are generally well known in the art. U.S. Pat. No. 6,364,683 discloses an electrical connector for a gas generator which includes a locking device that can move a shorting clip off of electrical connection with electrical contacts in a mating electrical connector.

There is a desire to make vehicle air bag gas generator electrical connectors very small such that they can be used in areas of limited space, such as in a seat belt, and that are lightweight for vehicle fuel economy reasons. However, in making such electrical connector smaller, it is difficult to determine if the electrical connector is properly installed in a mating connector. In the past, tactile feel and audible sounds during connection of the two connectors could be used as an indicator for the installer that a proper connection was made. However, with smaller size electrical connectors, there is not enough tactile feel or audible sound during connection to be a dependable source of good connection indication. Thus, there is a need for a dependable system for small electrical connectors to indicate connection to a mating connector which does not depend upon an audible or tactile signal to the user.

SUMMARY OF THE INVENTION

In accordance with one aspect of the present invention, an electrical connector is provided including a housing, electrical contacts and a connector position assurance (CPA) member. The housing has deflectable cantilevered mating connector latch arms. The latch arms are movable between a latched position and an unlatched position. The CPA member is movably mounted to the housing between an open position and a closed position. The CPA member includes a first section and a deflectable second section. The second section includes a cam surface for contacting a housing of the mating electrical connector and being deflected as the CPA member is moved from the open position to the closed position and an interference portion adapted to contact the latch arms when the latch arms are not in their latched position such that the CPA member is blocked from reaching the closed position unless the latch arms are in their latched positions.

In accordance with another aspect of the present invention, a vehicle air bag gas generator electrical connector is provided comprising a housing having deflectable latch arms, electrical contacts connected to the housing, and a connector position assurance (CPA) member movably mounted to the housing between an open position and a closed position. The CPA member comprising a first section adapted to move a shorting clip of a mating electrical connector and second sections. The second sections each have a cam surface for contacting a housing of the mating electrical connector and being deflected thereby as the CPA member is moved from the open position to the closed position, and an interference portion adapted to contact the latch arms if the latch arms are not in a latched position and thereby block deflection of the second sections to prevent the CPA member from being moved to the closed position unless the latch arms are in their latched positions.

In accordance with one method of the present invention, a method of assuring a position of an electrical connector in a mating connector is provided comprising steps of inserting a portion of the electrical connector into the mating connector; moving a connector position assurance (CPA) member from an open position on a housing of the electrical connector towards a closed position; deflecting a section of the CPA member by contact of the section with a housing of the mating connector as the CPA member is moved from the open position towards the closed position; and preventing the CPA member from reaching the closed position unless a latch on the housing of the electrical connector is located at a latched position. The step of preventing comprising the latch being located behind the section of the CPA member when the latch is not in its latched position to at least partially block deflection of the section by the housing of the mating connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
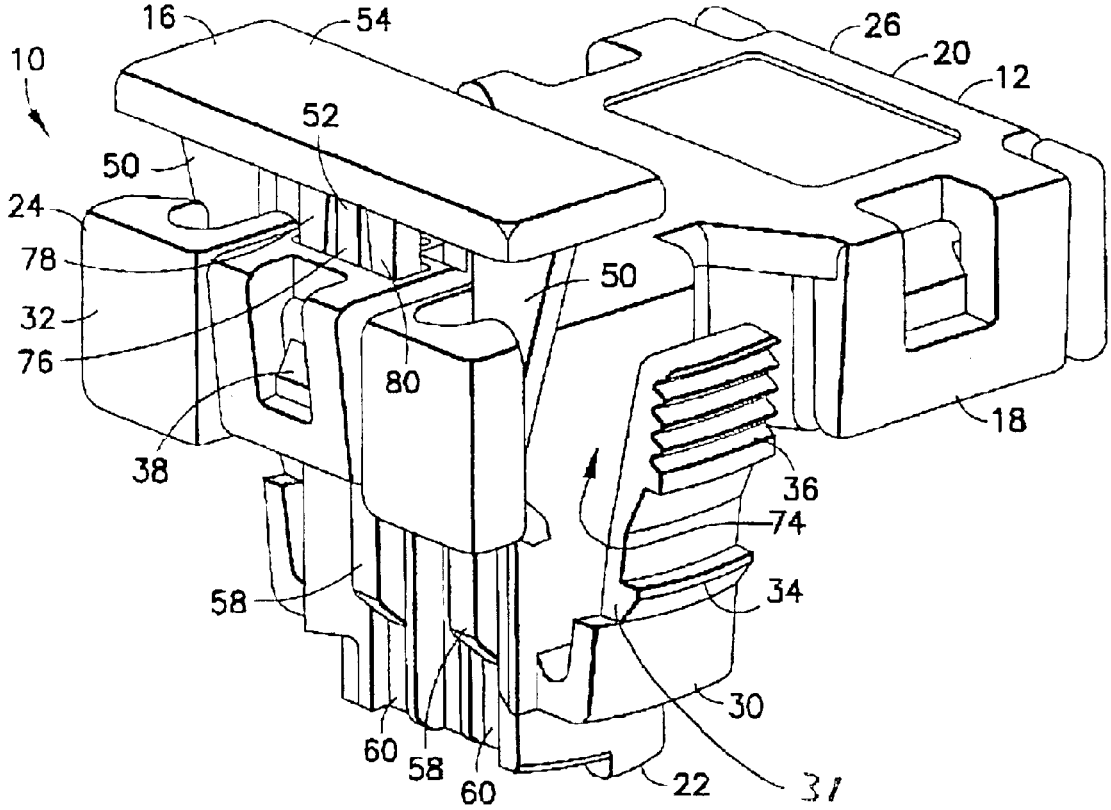
FIG. 1 is a perspective view of an electrical connector incorporating features of the present invention having a CPA member located in an open position.

Referring to FIG. 1, there is shown a perspective view of an electrical connector 10 incorporating features of the present invention. Although the present invention will be described with reference to the exemplary embodiments shown in the drawings, it should be understood that the present invention can be embodied in many alternate forms of embodiments. In addition, any suitable size, shape or type of elements or materials could be used.

Figure 2:
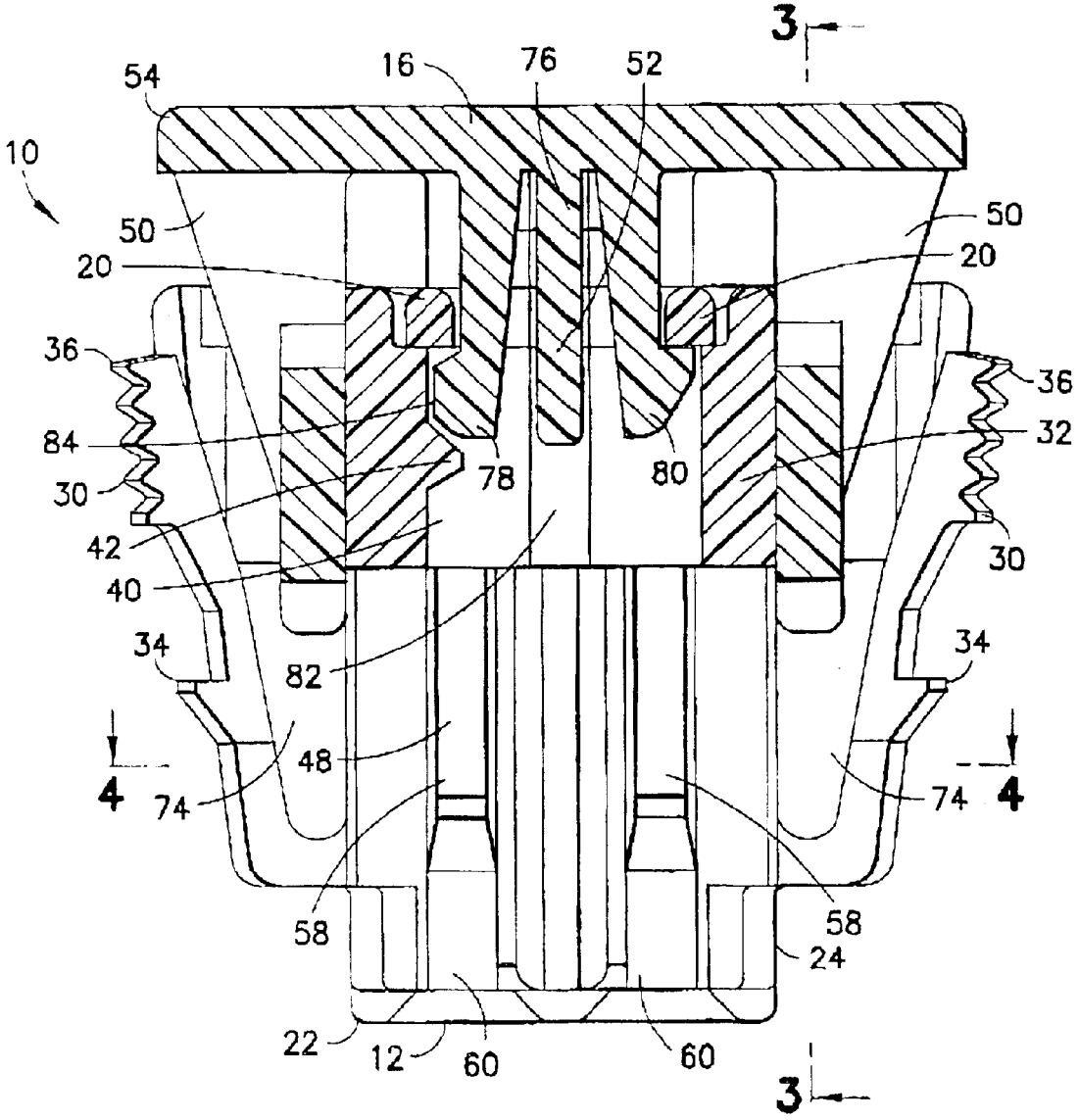
FIG. 2 is a cross sectional view of the electrical connector shown in FIG. 1.
Figure 3:
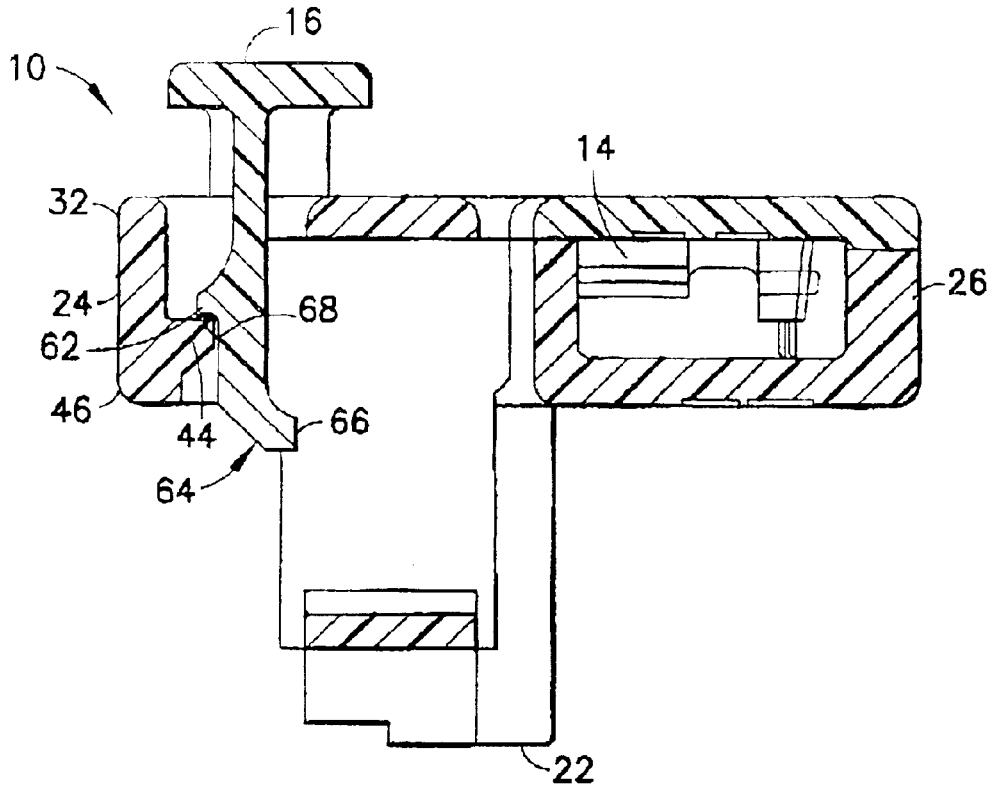
FIG. 3 is a cross sectional view of the electrical connector shown in FIG. 2 taken along line 3—3.
Figure 4:
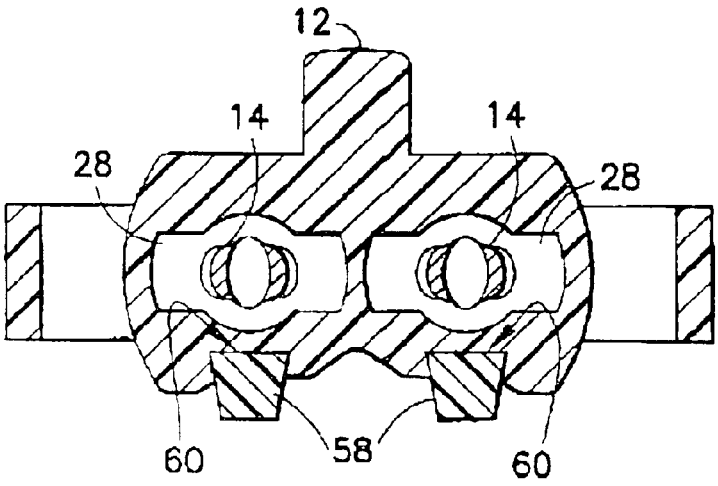
FIG. 4 is a cross sectional view of the connector shown in FIG. 2 taken along line 4—4.

Referring also to FIGS. 2–4, the electrical connector 10 generally comprises a housing 12, electrical contacts 14 (see FIG. 4), and a connector position assurance (CPA) member 16. The housing 12 generally comprises a main housing member 18 and a cover 20. The cover 20 is preferably snap lock mounted to the main housing member 18. In the embodiment shown the electrical connector 10 is a vehicle air bag gas generator electrical connector which is adapted to be attached to a mating electrical connector of a gas generator. The main housing member 18 comprises an end 22 which is sized and shaped to be removably inserted into a receiving area of the gas generator mating electrical connector. However, in alternate embodiments, features of the present invention could be used in any suitable type of electrical connector.

The housing 12 generally comprises the first section 24 and the second section 26. The first section 24 comprises contact receiving areas 28 (see FIG. 4), latch arms 30, and a detent and retaining section 32. The second section 26 is sized and shaped to receive ends of conductors, such as electrical wires (not shown) therein which are connected to the electrical contacts 14 inside the second section 26. In the embodiment shown, the second section 26 is located at a right angle to the first section 24. However, in an alternate embodiment, the electrical connector 10 might not be a right angle connector.

The main housing member 18 is preferably provided as a one-piece member and is preferably comprised of a molded plastic or polymer material. The latch arms 30 are located on two opposite lateral sides of the first section 24. The latch arms 30 extend upward and outward from the front end 22 in a general cantilever fashion. Each latch arm 30 comprises a latch 34 and the finger contact section 36. A user can depress the latch arms 30 in inward directions to move the latches 34. The latch arms 30 can preferably resiliently snap lock mount with the mating electrical connector when the end 22 is inserted into the socket receiving area of the mating electrical connector.

The detent and retaining section 32 generally comprises a latch 38, a detent receiving area 40 having a detent protrusion 42, and retaining protrusions 44 having retaining surfaces 46. The latch 38 is snap lock attached to the cover 20. The detent receiving area 40 is sized and shaped to receive a portion of the CPA member therein. The detent protrusion 42 extends in an inward direction into the detent receiving area 40. The protrusion 42 comprises sloped top and bottom surfaces. The detent and retaining section 32 comprises two of the retaining protrusions 44, one on each side of the first section 24. The retaining protrusions 44 extend in reward directions.

Figure 5:
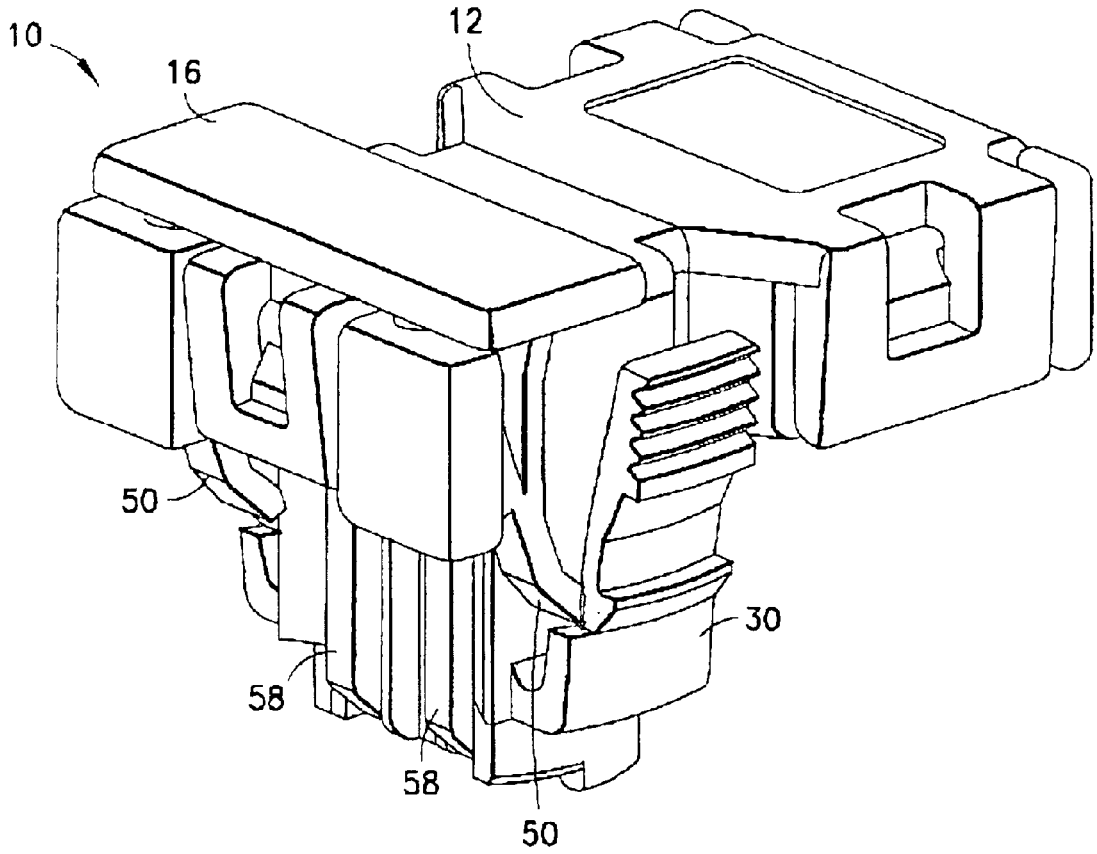
FIG. 5 is a perspective view of the electrical connector as shown in FIG. 1 with the CPA member located in its closed position.
Figure 6:
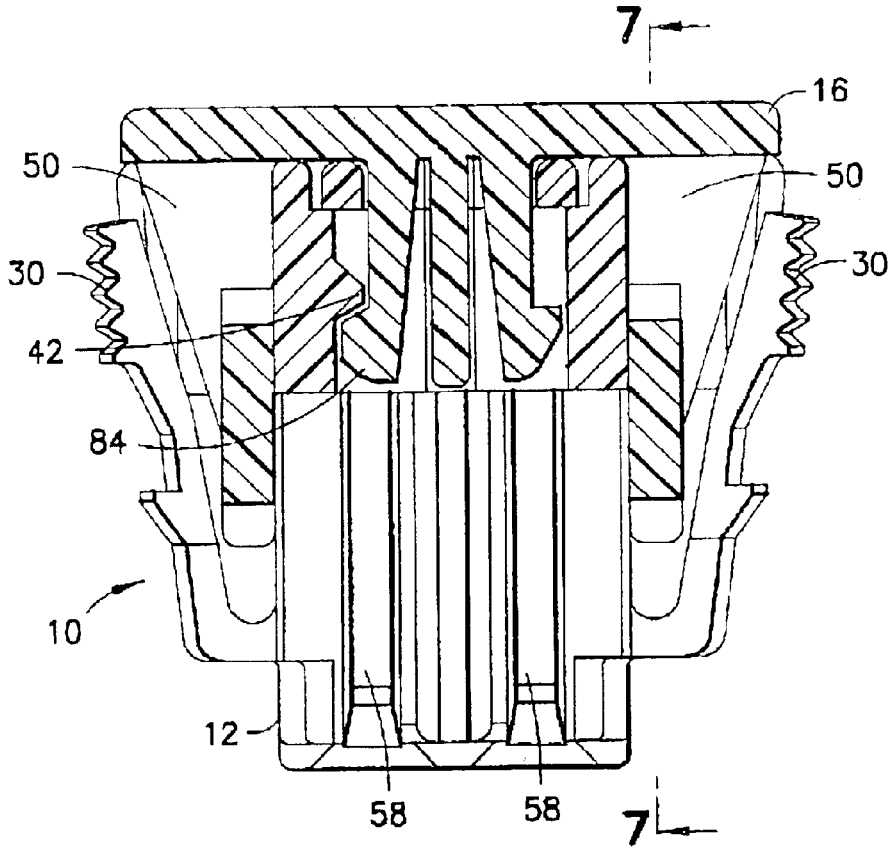
FIG. 6 is a cross sectional view of the electrical connector shown in FIG. 5.
Figure 7:
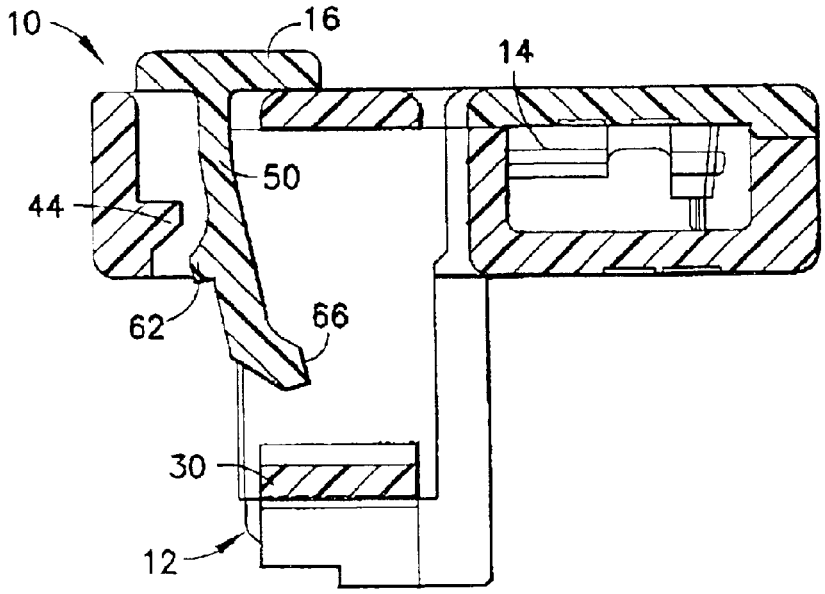
FIG. 7 is a cross sectional view of the electrical connector shown in FIG. 6 taken along line 7—7.

The CPA member 16 is preferably a one-piece member comprised of a molded plastic or polymer material. The CPA member 16 is movably mounted to the housing 12 between an open position as shown in FIGS. 1, 2 and 3, and a closed position as shown in FIGS. 5, 6 and 7. The CPA member 16 generally comprises a first section 48, two second sections 50, a third section 52 and a fourth section 54. The fourth section 54 forms a top surface for the CPA member 16 for a user to press the CPA member from its open position to its closed position. The first section 48 is adapted to move a shorting clip 56 of a mating electrical connector (see FIGS. 10 and 11).

In the embodiment shown, the first section 48 comprises two rails 58 which extend downward from the fourth section 54 and are slidable located in grooves 60 at the front of the main housing member 18. The bottom ends of the rails 58 are sloped to function as cam surfaces for moving portions of the shorting clip 56. More specifically, referring to FIGS. 10 and 11, the mating electrical connector comprises pin contacts 63 (only one of which is shown). The shorting clip 56 contacts the two pin contacts 63 in order to electrically connect the two pin contacts 63 with each other. The shorting clip 56 is only moved away from the pin contacts 63 when the electrical connector 10 is mated with the mating electrical connector and the CPA member 16 is moved to its closed position.

Figure 10:
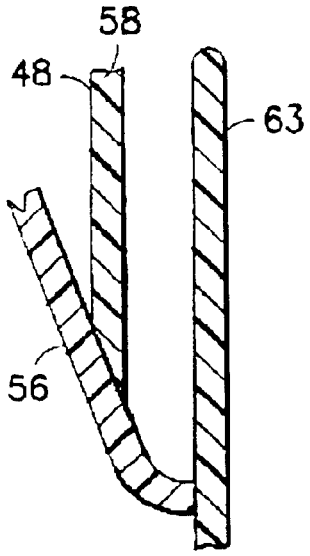
FIG. 10 is a partial cross sectional view of one of the rails of the electrical connector shown in FIG. 1 and a shorting clip and contact of a mating electrical connector with the rail of the CPA member located in its open position.
Figure 11:
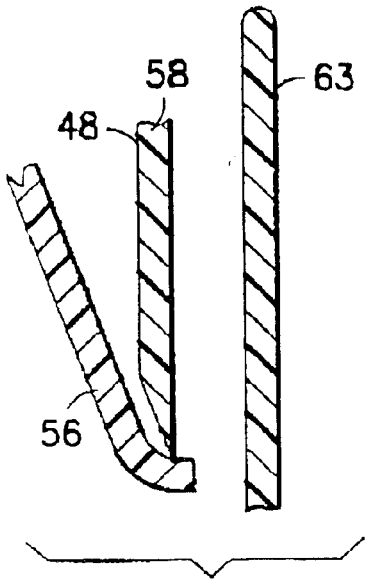
FIG. 11 is a partial cross sectional view as in FIG. 10 with the rail of the CPA member located in its closed position.

FIG. 10 shows one of the rails 58 when the CPA member 16 is in its open position. As can be seen, even though the electrical connector 10 is attached to the mating electrical connector, the shorting clip 56 still electrically connects the contact pins 63 with each other. FIG. 11 shows one of the rails 58 when the CPA member 16 is moved to its closed position. As can be seen, the bottom end of the rail 58 moves the shorting clip 56 to remove electrical connection between the shorting clip 56 and the pin contacts 63.

The second sections 50 are located at opposite lateral sides of the CPA member 16. The second sections 50 extend downward from the fourth section 54 in a general cantilever fashion. As seen best in FIG. 3, each second section SO generally comprises a retaining section 62, a cam surface 64, and an interference portion 66. The retaining section 62 extends in a general forward direction and comprises a retaining surface 68. With the CPA member 16 in its open position, the retaining surface 68 is located above the retaining surface 46 to prevent the CPA member 16 from being moved to its closed position.

Figure 8:
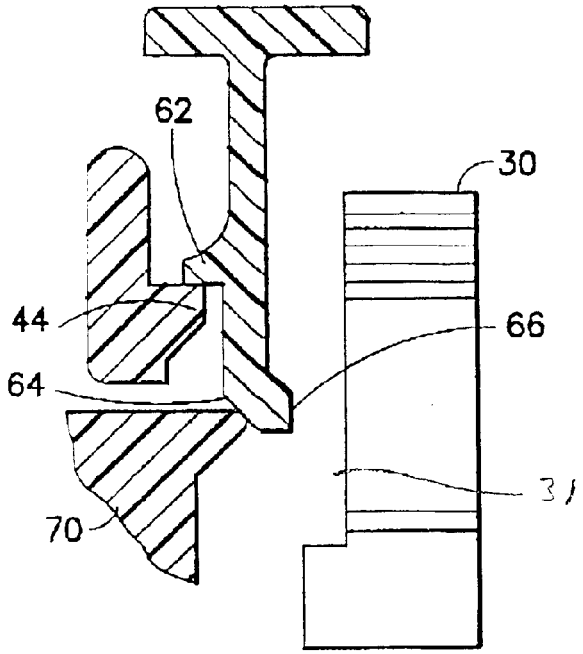
FIG. 8 is a partial schematic view of some of the components of the electrical connector shown in FIG. 1 when being inserted into the mating electrical connector.

The cam surface 64 is located at the bottom of the second section 50 and is adapted to contact a housing of the mating electrical connector as the CPA member 16 is moved from its open position to its closed position. More specifically, referring also to FIGS. 8 and 9, when the electrical connector 10 is attached to the mating electrical connector and the CPA member 16 starts to be depressed by a user, the cam surface 64 rides against a portion of the housing 70 of the mating electrical connector. This causes the second section 50 to deflect in a general cantilevered fashion in a reward direction 72 as shown in comparing FIG. 8 to FIG. 9. This caming action causes the retaining section 62 to be moved away from the retaining section 44 such that the two retaining surfaces 46, 68 are separated from each other. This enables the CPA member 16 to be fully depressed to its closed position as shown in FIG. 7.

As noted above, the second section 50 also comprises an interference portion 66. The interference portion 66 extends in a general reward direction at the bottom end of the second section 50. The interference portion 66 is located in line with a gap 74 between the latch arm 30 and the main portion of the first section 24. More specifically, when the CPA member 16 is in its open position, the interference portions 66 of the two second sections 50 are located in front of the gaps 74.

When the electrical connector 10 is fully inserted into the mating electrical connector and the latch arms 30 are located in their latched positions, the interference portion 66 can move into the gaps 74 as illustrated in FIG. 5. However, if the electrical connector 10 is not fully inserted into the mating electrical connector the latch arms 30 will not be located at their latched positions. The latch arms 30 would be deflected inward towards the main body of the first section 24. Thus, the gaps 74 would be reduced. The reduced size of the gaps 74 prevent the interference portions 66 from entering the gaps 74. Instead, the interference portions 66 would contact the front sides of the latch arms 30. Thus, the latch arms 30 would block movement of the interference portions 66 in a reward direction.

Figure 9:
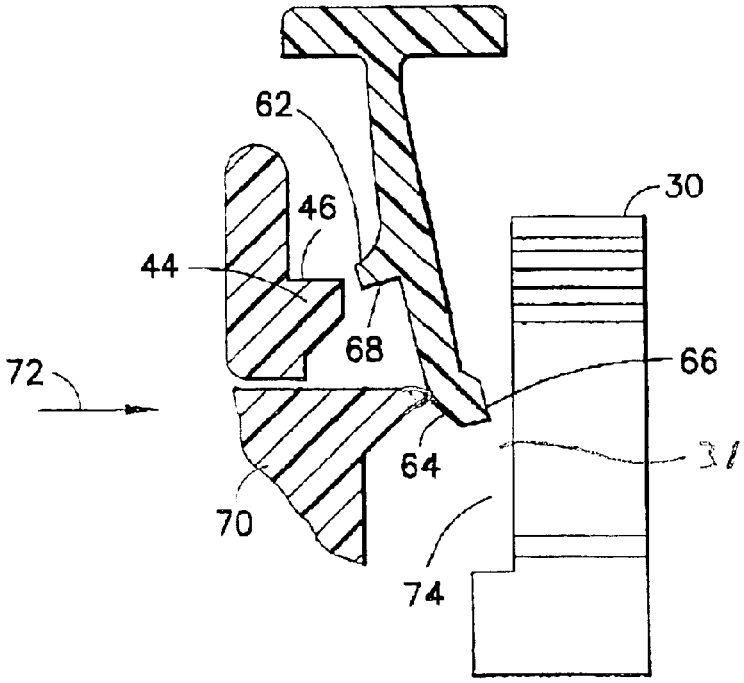
FIG. 9 is a partial schematic view as in FIG. 8 showing the CPA member partially moved from its open position towards its closed position.

As can be seen with reference to FIG. 9, in order for the retaining surfaces 46, 68 to pass each other as the CPA member 16 is depressed, the interference portions 66 are deflected towards the gaps 74. The latch arms 30 each include a front notch 31 on their front side. The notches 31 allow the interference portions 66 to move towards the latch arms 30 while the latch arms 30 are still being moved downward in the mating connector (i.e., before the latch arms have been able to fully spring back outward towards their home positions). Thus, the notches 31 function as a temporary clearance area, but the latch arms 30 must be in their home outward positions (i.e., latched positions) in order for the CPA member 16 to be moved to a fully downward position.

When the latch arms 30 are not in their latched positions, the interference portions 66 contact the front surfaces of the latch arms 30 at the notches 31 and the interference portions 66 are prevented from entering the gaps 74. Thus, the second sections 50 are prevented from being fully deflected to allow the retaining sections 44, 62 to disengage each other. Therefore, the two retaining sections 44, 62 engage each other to prevent the CPA member 16 from being moved to its closed position. The inability to move the CPA member 16 to its fully closed position immediately signals to the user that the electrical connector 10 is not fully inserted into the mating electrical connector.

The third section 52 comprises a latch detent section for retaining the CPA member 16 at either the open position or the closed position. In the embodiment shown, the third section 52 generally comprises a center guide member 76 and two latch arms 78, 80. The center guide member 76 and the latch arms 78, 80 extend downward from the fourth section 54 in a general cantilever fashion. The center guide member 76 and the latch arms 78, 80 extend through an aperture in the cover 20 and into the detent receiving area 40 of the main housing member 18. The two latch arms 78, 80 interact with the bottom surface of the cover 20 to prevent disconnection of the CPA member 16 from the electrical connector. The center guide member 76 is slidably located in a groove 82 of the main housing member 18. The first latch arm 78 includes a detent section 84 which is located above the detent protrusion 42 when the CPA member 16 is in its open position. Referring also to FIG. 6, when the CPA member 16 is moved to its closed position, the first latch arm 78 is able to resiliently deflect inward and outward again such that the detent section 84 is now located below the detent protrusion 42. Once the CPA member 16 is moved to its closed position, the detent system described above can help prevent the CPA member 16 from unintentionally moving back to its open position unless a user applies a sufficient amount of force.

After the electrical connector 10 is properly inserted into the mating electrical connector and the CPA member 16 is moved to its closed position, the CPA member 16 prevents the side latches 30 from being inwardly deflected to their unlatched positions. The interference portions 66, located in the gaps 74, prevent the side latches 30 from being fully inwardly deflected. Thus, the CPA member 16 prevents the electrical connector 10 from being inadvertently unlatched from the mating electrical connector. The CPA member 16 must be moved to its open position before the electrical connector 10 can be unlatched and disconnected from the mating electrical connector. This also insures that the shorting clip 56 is connected to the two contacts 63 before the contacts 14 of the electrical connector 10 are disconnected from the contacts 63.

Figure 12:
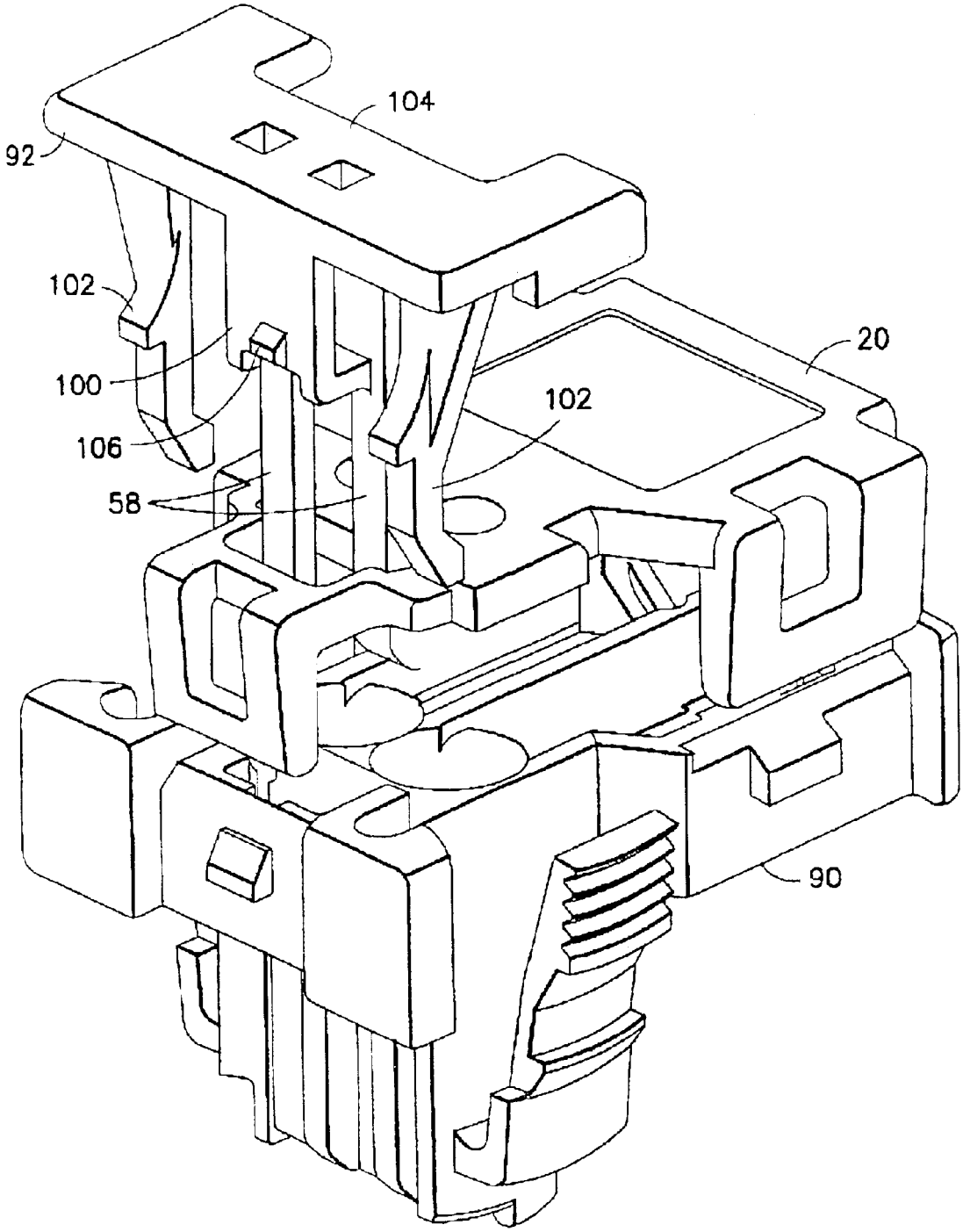
FIG. 12 is an exploded perspective view of an alternate embodiment of the present invention.
Figure 13:
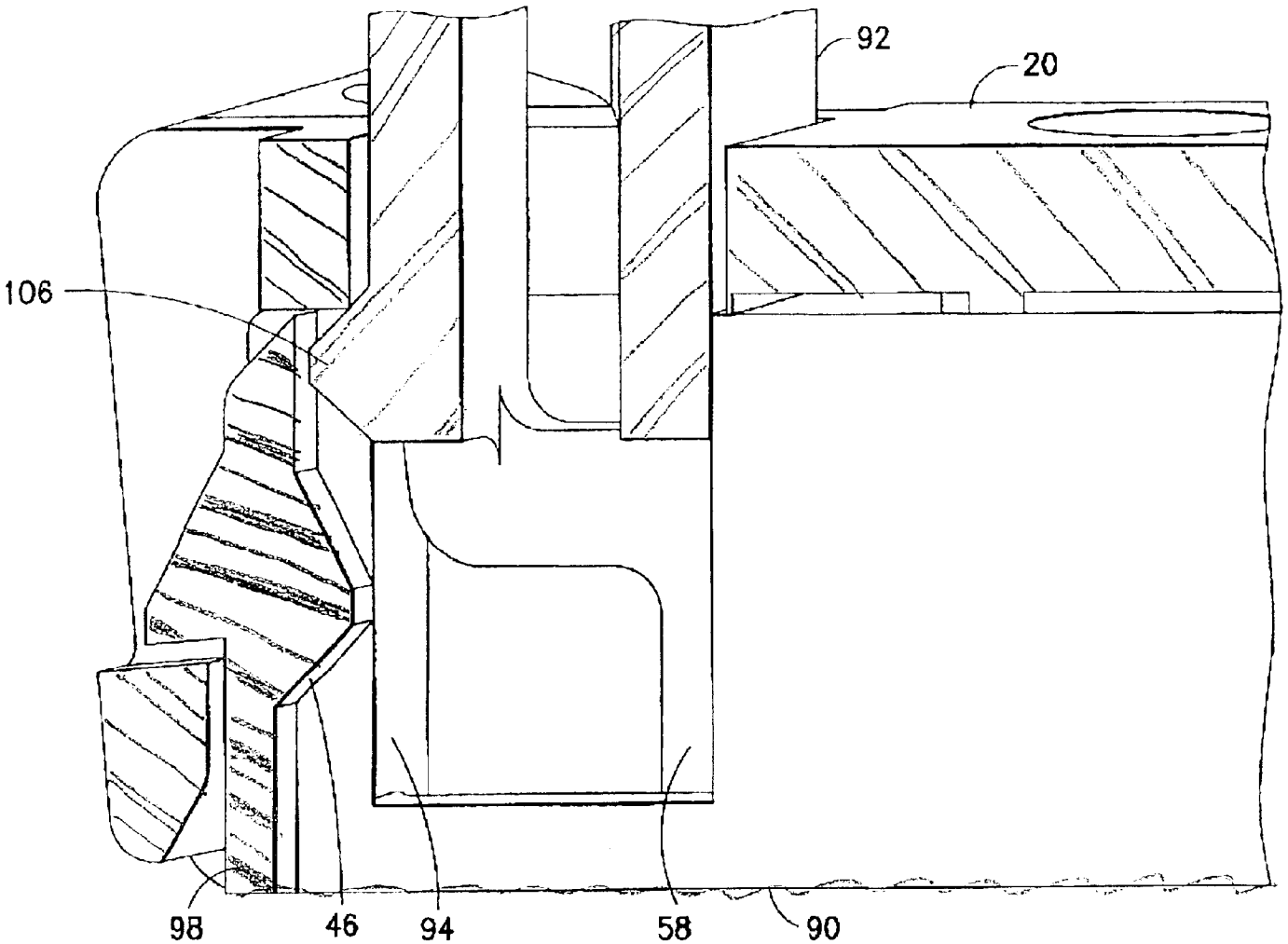
FIG. 13 is an enlarged partial cross sectional view of the housing and CPA member shown in FIG. 12.
Figure 14:
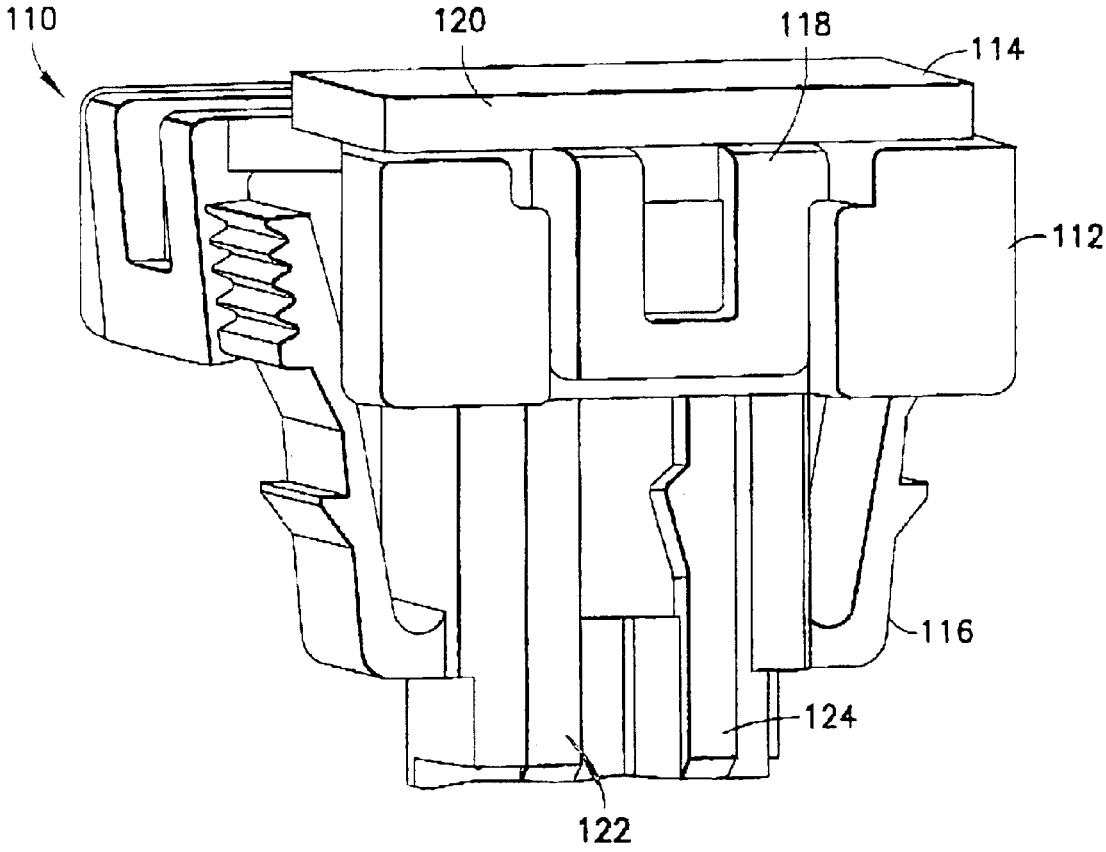
FIG. 14 is a perspective view of another alternate embodiment of the present invention.

Referring now to FIGS. 12 and 13, an alternate embodiment of the present invention is shown. In this embodiment the cover 20 is the same as that shown in the first embodiment. However, in this embodiment main housing member 90 and the CPA member 92 are slightly different. The main housing member 90 includes a detent receiving area 94 with a detent protrusion 96. The detent protrusion 96 extends in a reward direction from the front latching wall 98 of the main housing member 90. The CPA member 92 has a center section 100 and two side sections 102 which extend downward from the top 104. The two side sections 102 are identical to the second sections 50 shown in the first embodiment. The center section 100 comprises the two rails 58 and a front portion having a forward extending detent protrusion 106.

When the CPA member 92 is in its open position, the detent protrusion 106 is located above the detent protrusion 96. When the CPA member 92 is moved towards its closed position, the detent protrusion 106 can be resiliently wedged inward by the detent protrusion 96 and the detent protrusion 106 can subsequently be located below the detent protrusion 96 to retain the CPA member 92 in its closed position. Once the CPA member 92 is moved to its closed position, the detent system described above can help prevent the CPA member 92 from unintentionally moving back to its open position unless a user applies a sufficient amount of force.

Referring now to FIGS. 14–18, another alternate embodiment will be described. In this embodiment the electrical connector 110 includes a housing 112 and a CPA member 114. The housing 112 includes a main housing member 116 and a cover 118. The CPA member 114 includes a top 120 and two rails 122, 124. The two rails 122, 124 comprise: outwardly extending latch protrusions 126. The latch protrusions 126 are located below the cover 118 and prevent the CPA member 114 from being disconnected from the housing 112. The second rail 124 also comprises two inward facing protrusions or projections 128, 130. The protrusions 128, 130 project from the first rail 128 in a direction towards the second rail 130. The first projection 128 has a general pyramid shaped cross section. A space is provided between the rails 122, 124 for receiving a portion of the housing of the mating electrical connector.

Figure 16:
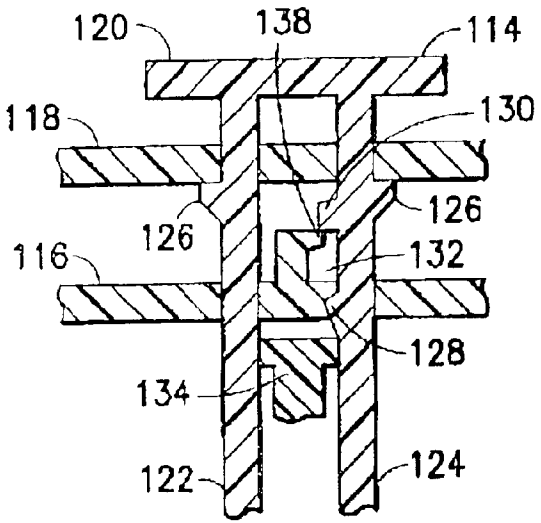
FIG. 16 is a partial cross sectional view of the electrical connector shown in FIG. 14 with the CPA member in an open position and the electrical connector not fully inserted into the mating electrical connector.

The main housing member 116 includes a lateral facing receiving area 132 which is adapted to receive the second protrusion 130. In the open position, the second protrusion 130 is located above the receiving area 132 as indicated in FIG. 16. As indicated by comparing FIG. 16 to FIGS. 17 and 18, in order to move the second protrusion 130 into the receiving area 132 a portion of the second rail 124 must be deflected laterally outward. In order to accomplish this, the second rail 124 uses the first protrusion 128 and its interaction with the housing 134 of the mating electrical connector. More specifically, as the electrical connector 110 is mounted to the mating electrical connector the housing 134 of the mating electrical connector contacts the bottom surface of the first protrusion 128 and deflects the rail 124 outward. The CPA member 114 can then be depressed to move the second protrusion 130 into the receiving area 132. The first protrusion 128 moves below the ledge 136 of the housing 134 for the rail 124 to straighten.

Figure 15:
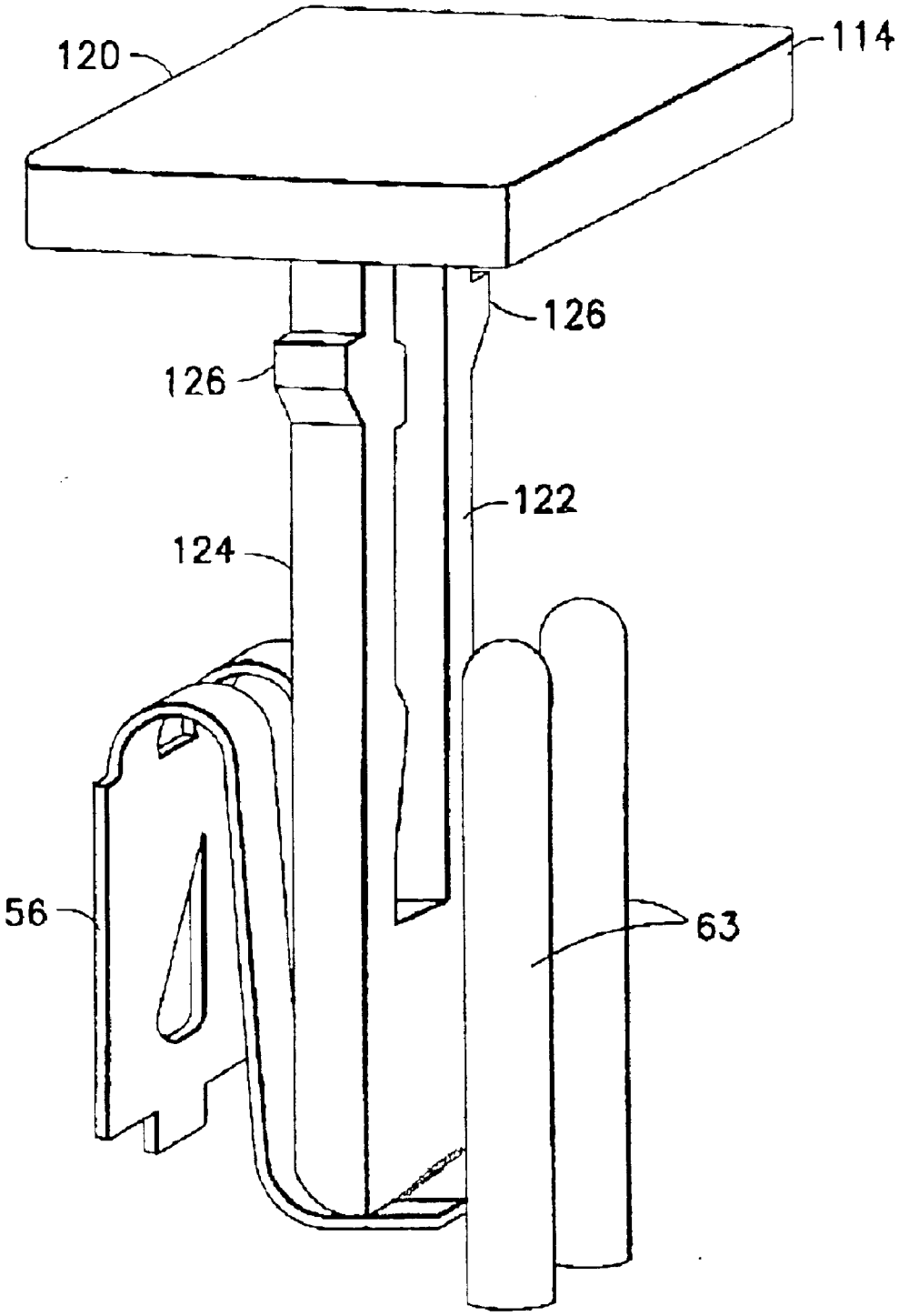
FIG. 15 is a perspective view of the CPA member of the connector shown in FIG. 14 and a shorting clip that contacts pins of a mating electrical connector.
Figure 18:
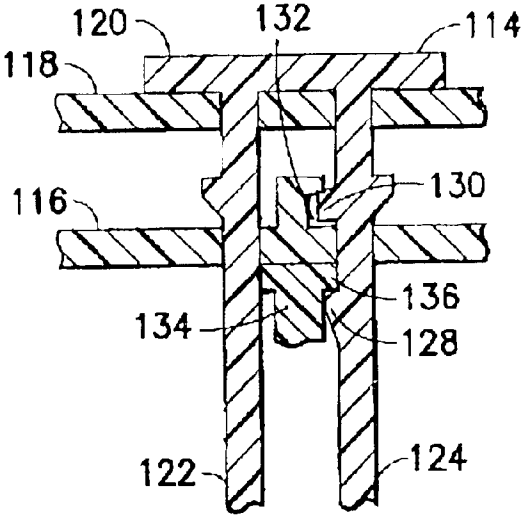
FIG. 18 is a partial cross sectional view as in FIGS. 16 and 17 with the electrical connector fully inserted into the mating electrical connector and the CPA member moved to its closed position.
Figure 17:
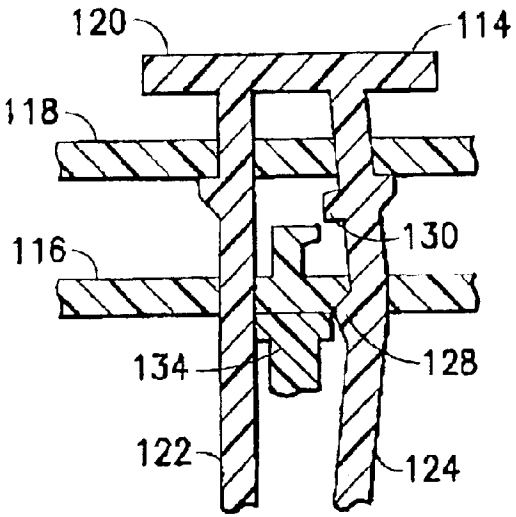
FIG. 17 is a partial cross sectional view as in FIG. 16 with the electrical connector fully inserted into the mating electrical connector, but the CPA member still located in an open position.

Without the housing 134 of the mating electrical connector deflecting the rail 124 outward, the second protrusion 130 would not be able to pass by the wedge 138 located above the receiving area 132. Thus, without the electrical connector 110 being mounted to the mating electrical connector, the CPA member 114 is prevented from moving from its open position to its closed position. As shown in FIG. 15, the rails 122, 124 also function to contact the shorting clip 56 to move the clip off of engagement with the contact pins 63 of the mating electrical connector similar to that described above in regard to the first embodiment. In one type of alternate embodiment, the bottom ends of the rails 122, 124 could be connected to each other.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing having a deflectable cantilevered mating connector latch arm, wherein the latch arm is movable between a latched position and an unlatched position;

electrical contacts connected to the housing; and a connector position assurance (CPA) member movably mounted to the housing between an open position and a closed position, the CPA member comprising a first section adapted to move a shorting clip of a mating electrical connector and a deflectable second section, the second section comprising a cam surface for contacting a housing of the mating electrical connector and being deflected as the CPA member is moved from the open position to the closed position and an interference portion adapted to contact the latch arm when the latch arm is not in its latched position such that the CPA member is blocked from reaching the closed position unless the latch arm is in its latched position.

2. An electrical connector as in claim 1 wherein the latch arm extends in a general cantilever fashion from a leading insertion end of the housing.

3. An electrical connector as in claim 1 wherein the first section of the CPA member comprises rails slidably mounted in grooves along an exterior side of the housing.

4. An electrical connector as in claim 1 wherein the CPA member further comprises a latch detent section for retaining the CPA member at either the open position or the closed position.

5. An electrical connector as in claim 4 wherein the latch detent section comprises an inwardly deflectable arm adapted to be located above a protrusion on the housing when the CPA member is in the open position and adapted to be located below the protrusion when the CPA member is in the closed position.

6. An electrical connector as in claim 1 wherein the second section comprises a retaining surface which engages a retaining surface on the housing to retain the CPA member in the open position and prevents the CPA member from being moved from the open position to the closed position unless the second section is deflected inward by contact between the cam surface and the housing of the mating connector to disengage the retaining surfaces from each other.

7. In a vehicle air bag gas generator electrical connector comprising a housing having deflectable latch arms, electrical contacts connected to the housing, and a connector position assurance (CPA) member movably mounted to the housing between an open position and a closed position, wherein the improvement comprises:

the CPA member comprising a first section adapted to move a shorting clip of a mating electrical connector and second sections, the second sections each having a cam surface for contacting a housing of the mating electrical connector and being deflected thereby as the CPA member is moved from the open position to the closed position, and an interference portion adapted to contact the latch arms if the latch arms are not in a latched position and thereby block deflection of the second sections to prevent the CPA member from being moved to the closed position unless the latch arms are in their latched positions.

8. A vehicle air bag gas generator electrical connector as in claim 7 wherein the latch arms extend in a general cantilever fashion from a leading insertion end of the housing.

9. A vehicle air bag gas generator electrical connector as in claim 7 wherein the first section of the CPA member comprises rails slidably mounted in grooves along an exterior side of the housing.

10. A vehicle air bag gas generator electrical connector as in claim 7 wherein the CPA member further comprises a latch detent section for retaining the CPA member at either the open position or the closed position.

11. A vehicle air bag gas generator electrical connector as in claim 10 wherein the latch detent section comprises an inwardly deflectable arm adapted to be located above a protrusion on the housing when the CPA member is in the open position and adapted to be located below the protrusion when the CPA member is in the closed position.

12. A vehicle air bag gas generator electrical connector as in claim 7 wherein the second section comprises a retaining surface which engages a retaining surface on the housing to retain the CPA member in the open position and prevents the CPA member from being moved from the open position to the closed position unless the second section is deflected inward by contact between the cam surface and the housing of the mating connector to disengage the retaining surfaces from each other.

13. A method of assuring a position of an electrical connector in a mating connector comprising steps of:

inserting a portion of the electrical connector into the mating connector;

moving a connector position assurance (CPA) member from an open position on a housing of the electrical connector towards a closed position;

deflecting a section of the CPA member by contact of the section with a-housing of the mating connector as the CPA member is moved from the open position towards the closed position; and preventing the CPA member from reaching the closed position unless a latch on the housing of the electrical connector is located at a latched position, the step of preventing comprising the latch being located behind the section of the CPA member when the latch is not in its latched position to at least partially block deflection of the section by the housing of the mating connector.

14. A method as in claim 13 wherein the step of preventing further comprises locating a retaining surface of the section above a retaining surface of the housing when the CPA member is at the open position, and preventing the retaining surfaces from disengaging each other unless the section is deflected inward by the contact of the section with the housing of the mating connector.

15. A method as in claim 13 further comprising a detent locating the CPA member on the housing at the closed position.

16. A method as in claim 13 wherein the step of moving the CPA member towards the closed position comprises moving a rail section of the CPA member along an exterior side of the housing to move a shorting clip of the mating connector.

17. An electrical connector comprising:

a housing having a deflectable cantilevered mating connector latch arm, wherein the latch arm is movable between a latched position and an unlatched position;

electrical contacts connected to the housing; and a connector position assurance (CPA) member movably mounted to the housing between an open position and a closed position, the CPA member comprising a first section adapted to move a shorting clip of a mating electrical connector and a deflectable second section, the second section comprising a cam surface which is adapted to contact a housing of the mating electrical connector when the electrical connector is inserted into the housing of the mating electrical connector and be deflected by the housing of the mating electrical connector, and wherein the deflectable second section is adapted to be further deflected as the CPA member is moved from the open position to the closed position.

18. An electrical connector as in claim 17 wherein the CPA member comprises an interference portion adapted to contact the latch arm when the latch arm is not in its latched position such that the CPA member is blocked from reaching the closed position unless the latch arm is in its latched position.

19. An electrical connector as in claim 17 wherein the deflectable second section is adapted to be deflected by the housing of the mating electrical connector in a first direction when the electrical connector is inserted into the housing of the mating electrical connector, and wherein the deflectable second section is adapted to be further deflected in the same first direction when the CPA member is moved from the open position to the closed position.

20. An electrical connector comprising:

a housing having a deflectable cantilevered mating connector latch arm, wherein the latch arm is movable between a latched position and an unlatched position;

electrical contacts connected to the housing; and a connector position assurance (CPA) member movably mounted to the housing between an open position and a closed position, the CPA member comprising a deflectable section comprising a cam surface for contacting a housing of a mating electrical connector when the electrical connector is inserted into the mating electrical connector, and wherein the deflectable section is adapted to be deflected into a gap behind the latch arm and another portion of the housing of the electrical connector as the CPA member is moved from the open position to the closed position.

21. An electrical connector as in claim 20 wherein the CPA member comprises an interference portion adapted to contact the latch arm when the latch arm is not in its latched position such that the CPA member is blocked from reaching the closed position unless the latch arm is in its latched position.

22. An electrical connector as in claim 20 wherein the CPA member is adapted to move a shorting clip of the mating electrical connector when the CPA member is moved from the open position to the closed position.

23. An electrical connector as in claim 20 wherein the deflectable section is adapted to be deflected into the gap behind the latch arm by the housing of the mating electrical connector as the CPA member is moved from the open position to the closed position.

* * * * *